US007651380B2

(12) United States Patent
Below et al.

(10) Patent No.: US 7,651,380 B2
(45) Date of Patent: Jan. 26, 2010

(54) MODULAR PLUGS AND OUTLETS HAVING ENHANCED PERFORMANCE CONTACTS

(75) Inventors: Randy J. Below, Cheshire, CT (US); Olindo Savi, Kensington, CT (US); Maxwell K. Yip, Trumbull, CT (US); Daniel J. Mullin, Plantsville, CT (US); John A. Siemon, Woodbury, CT (US)

(73) Assignee: The Siemon Company, Watertown, CT (US)

( * ) Notice: Subject to any disclaimer, the term of this patent is extended or adjusted under 35 U.S.C. 154(b) by 0 days.

(21) Appl. No.: 11/672,674

(22) Filed: Feb. 8, 2007

(65) Prior Publication Data

US 2007/0197083 A1 Aug. 23, 2007

Related U.S. Application Data

(60) Provisional application No. 60/771,535, filed on Feb. 8, 2006.

(51) Int. Cl.
*H01R 24/00* (2006.01)

(52) U.S. Cl. ..... 439/676; 439/924.1

(58) Field of Classification Search ..... 439/676, 439/941, 924.1

See application file for complete search history.

(56) References Cited

U.S. PATENT DOCUMENTS 6,083,052 A 7/2000 Adams et al.
6,126,476 A 10/2000 Viklund et al.
6,213,809 B1 4/2001 Viklund
6,361,354 B1 3/2002 Viklund et al.
6,368,144 B2 4/2002 Viklund
6,533,618 B1 * 3/2003 Aekins ..... 439/676
6,629,862 B2 * 10/2003 Schmidt et al. ..... 439/676
6,749,466 B1 * 6/2004 Milner et al. ..... 439/676
6,802,743 B2 * 10/2004 Aekins et al. ..... 439/676
6,840,816 B2 * 1/2005 Aekins ..... 439/676
6,869,318 B2 * 3/2005 Viklund et al. ..... 439/676
6,994,594 B2 * 2/2006 Milner et al. ..... 439/676
6,994,597 B2 * 2/2006 Majima ..... 439/752
7,168,994 B2 * 1/2007 Caveney et al. ..... 439/676
7,186,148 B2 * 3/2007 Hashim ..... 439/676
2001/0012722 A1 8/2001 Adams
2002/0177368 A1 11/2002 Hyland

OTHER PUBLICATIONS

International Search Report, PCT/US 07/03414, Feb. 27, 2008.

* cited by examiner

*Primary Examiner*—Truc T Nguyen
(74) *Attorney, Agent, or Firm*—Cantor Colburn LLP

(57) ABSTRACT

A telecommunications outlet including a contact carrier and a plurality of contacts supported on the contact carrier, the contacts corresponding to tip and ring pairs, at least one of the contacts having a characteristic to improves signal transmission performance by providing internal compensation to balance signals by controlling resistive, inductive or capacitive characteristics along the contacts.

11 Claims, 8 Drawing Sheets

MODULAR PLUGS AND OUTLETS HAVING ENHANCED PERFORMANCE CONTACTS

CROSS-REFERENCE TO RELATED APPLICATIONS

This application claims the benefit of provisional application Ser. No. 60/771,535, filed Feb. 8, 2006, the entire contents of which are incorporated herein by reference.

BACKGROUND

The invention relates generally to an enhanced performance connector and in particular, to a connector including a plug and outlet designed for enhanced performance.

Improvements in telecommunications systems have resulted in the ability to transmit voice and/or data signals along transmission lines at increasingly higher frequencies. Several industry standards that specify multiple performance levels of twisted-pair cabling components have been established. The primary references, considered by many to be the international benchmarks for commercially based telecommunications components and installations, are standards ANSI/TIA/EIA-568-A (/568) Commercial Building Telecommunications Cabling Standard and ISO/IEC 11801 (/11801), generic cabling for customer premises. For example, Category 3, 4 and 5 cable and connecting hardware are specified in both /568 and /11801, as well as other national and regional specifications. In these specifications, transmission requirements for Category 3 components are specified up to 16 MHz. Transmission requirements for Category 4 components are specified up to 20 MHz. Transmission requirements for Category 5 components are specified up to 100 MHz. The above referenced transmission requirements also specify limits on near-end crosstalk (NEXT).

Often, telecommunications connectors are organized in sets of pairs, typically made up of a tip and ring connector. As telecommunications connectors are reduced in size, adjacent pairs are placed closer to each other creating crosstalk between adjacent pairs. To comply with the near-end crosstalk requirements, a variety of techniques are used in the art.

Compensation for the modular jacks and plugs has been added using external elements such as a PCB, flex circuits, discreet components (i.e. resistors, capacitors). These previous methods add cost and complexity. As the bandwidth requirements increase due to higher signaling rates, such as 10GBASE-T Ethernet and beyond, components need to be improved.

While there exist plugs and outlets designed to reduce crosstalk and enhance performance, it is understood in the art that improved plugs and outlets are needed to meet increasing transmission rates.

SUMMARY

An embodiment of the invention is a telecommunications outlet including a contact carrier and a plurality of contacts supported on the contact carrier, the contacts corresponding to tip and ring pairs, at least one of the contacts having a characteristic to improve signal transmission performance by providing internal compensation to balance signals by controlling resistive, inductive or capacitive characteristics along the contacts.

DETAILED DESCRIPTION

Figure 1:
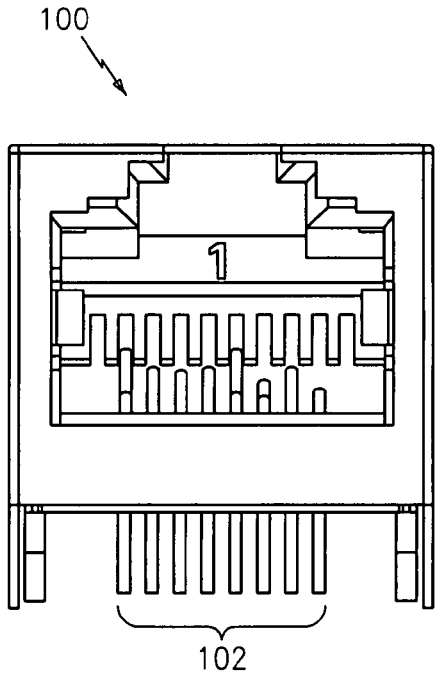
FIG. 1 is a front view of an outlet in embodiments of the invention.

FIG. 1 is a front view of an outlet 100 in embodiments of the invention. As known in the art, the outlet includes eight contacts 102. It is understood that the number of contacts may vary depending on application, and embodiments of the invention are not limited to eight contacts. As is known in the art, contacts are referred to as being in eight positions 1-8, from one side of the outlet to the other. The contacts may be arranged in tip and ring pairs as is known in the art with, contacts 1/2, 3/6, 4/5 and 7/8 defining tip and ring pairs. Embodiments of the invention are described with reference to contacts in different positions.

Figure 2:
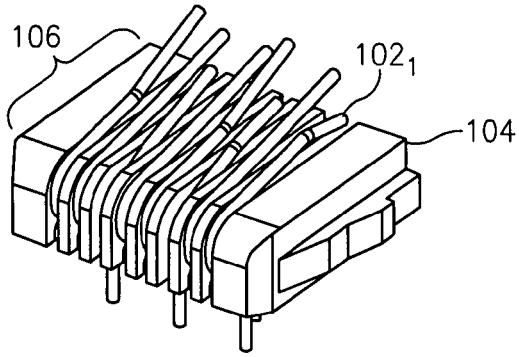
FIG. 2 is a perspective view of a contact carrier of FIG. 1.
Figure 3:
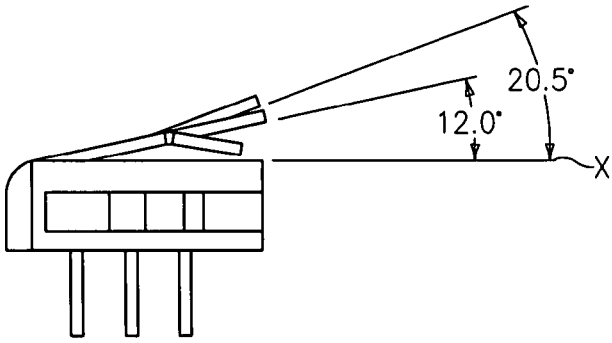
FIG. 3 is a side view of the contact carrier of FIG. 2.

FIG. 2 is a perspective view of a contact carrier 104 of FIG. 1, depicting the first contact as $\mathbf{102}_1$. In this embodiment crosstalk is reduced by altering features of the contacts 102. One feature is the length of the contacts. In FIG. 2, contacts in positions 3 and 6 are shorter than the other contacts. Thus, contacts 3 and 6 do not extend as far in the mating region 106 above the top surface of contact carrier 104 where contacts from a plug make electrical contact with contacts 102. Another feature is the angle of the contact with respect to an axis X parallel to the top surface of the contact carrier. Contacts in positions 4, 6 and 8 are at a first angle (e.g., 20.5 degrees) with reference to axis X. Other contacts in positions 2, 5 and 7 are at a second angle (e.g., 12 degrees) with reference to axis X. Another feature is the inclusion of a bend in the contact, such that the angle of the contact with reference to axis X decreases at the bend. As shown in FIGS. 2 and 3, contact in position 1 has a bend towards axis X.

This arrangement of the contacts improves signal transmission performance by providing internal compensation to balance signals by adjusting the contacts to maximize resistive, inductive, capacitive characteristics (including signal phase delay) along contacts 102. For example, adjusting the length, adding bends, adjusting the spacing of the contacts is performed to compensate for crosstalk within the outlet. Further, the cross sectional size of the contacts, the cross sectional shape of the contacts and/or the conductivity of the material used in one or more of the contacts may be varied to alter resistive, inductive, capacitive characteristics (including signal phase delay) of contacts 102.

Figure 4:
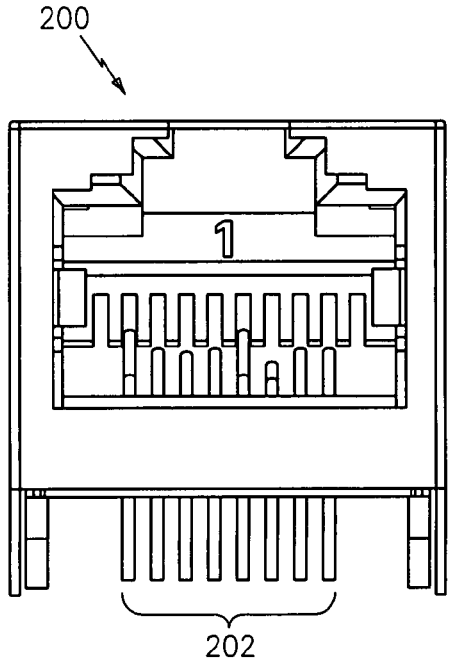
FIG. 4 is a front view of an outlet in alternate embodiments of the invention.

FIG. 4 is a front view of an outlet 200 in embodiments of the invention. As known in the art, the outlet includes eight contacts 202. It is understood that the number of contacts may vary depending on application, and embodiments of the invention are not limited to eight contacts. As is known in the art, contacts are referred to as being in eight positions 1-8, from one side of the outlet to the other. The contacts may be arranged in tip and ring pairs as is known in the art with, contacts 1/2, 3/6, 4/5 and 7/8 defining tip and ring pairs.

Figure 5:
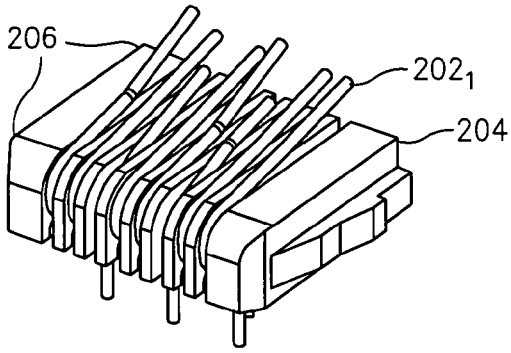
FIG. 5 is a perspective view of a contact carrier of FIG. 4.
Figure 6:
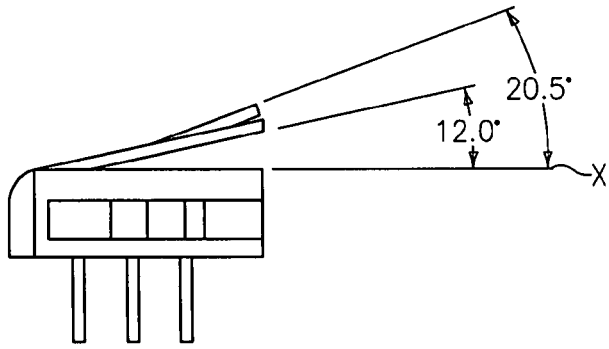
FIG. 6 is a side view of the contact carrier of FIG. 5.

Embodiments of the invention are described with reference to contacts in different positions. FIG. 5 is a perspective view of a contact carrier 204 of FIG. 4, depicting the first contact as $\mathbf{202}_1$. In this embodiment crosstalk is reduced by altering features of the contacts 202. One feature is the length of the contacts. In FIG. 5, contacts in positions 3 and 6 are shorter than the other contacts. Thus, contacts 3 and 6 do not extend as far in the mating region 206 above the top surface of contact carrier 104 where contacts from a plug make electrical contact with contacts 102. Another feature is the angle of the contact with respect to an axis X parallel to the top surface of the contact carrier. As shown in FIG. 6, contacts in positions 4, 6 and 8 are at a first angle (e.g., 20.5 degrees) with reference to axis X. Other contacts in positions 1, 2, 3, 5 and 7 are at a second angle (e.g., 12 degrees) with reference to axis X.

This arrangement of the contacts improves signal transmission performance by providing internal compensation to balance signals by adjusting the contacts to maximize resistive, inductive, capacitive characteristics (including signal phase delay) along contacts 202. For example, adjusting the length, adding bends, adjusting the spacing of the contacts is performed to compensate for crosstalk within the outlet. Further, the cross sectional size of the contacts, the cross sectional shape of the contacts and/or the conductivity of the material used in one or more of the contacts may be varied to alter resistive, inductive, capacitive characteristics (including signal phase delay) of contacts 202.

Figure 7:
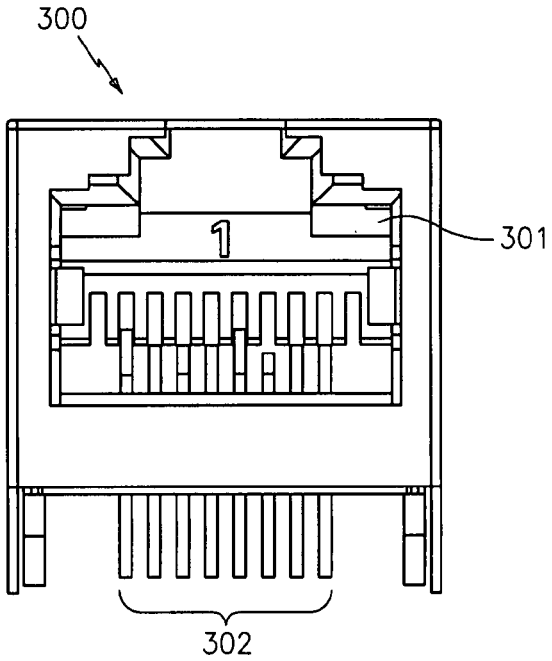
FIG. 7 is a front view of an outlet in alternate embodiments of the invention.

FIG. 7 is a front view of an outlet 300 in alternate embodiments of the invention. As known in the art, the outlet includes eight contacts 302. It is understood that the number of contacts may vary depending on application, and embodiments of the invention are not limited to eight contacts. As is known in the art, contacts are referred to as being in eight positions 1-8, from one side of the outlet to the other. The contacts may be arranged in tip and ring pairs as is known in the art with, contacts 1/2, 3/6, 4/5 and 7/8 defining tip and ring pairs. Embodiments of the invention are described with reference to contacts in different positions.

Figure 8:
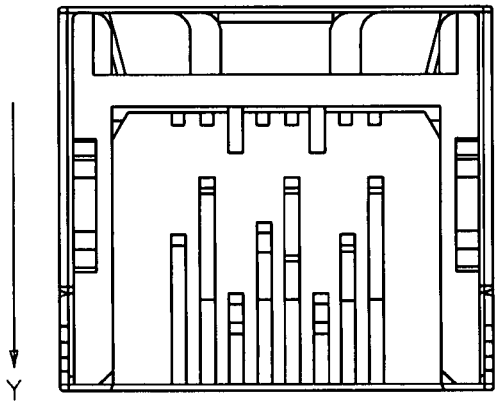
FIG. 8 is a bottom view of the outlet of FIG. 7.
Figure 9:
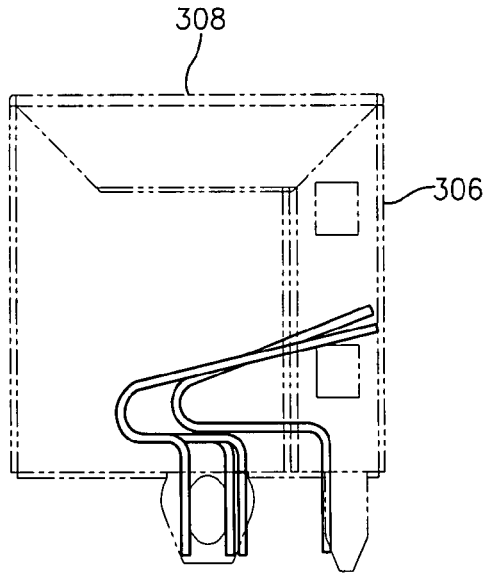
FIG. 9 illustrates contacts within the outlet of FIG. 7.

FIG. 8 is a bottom view of the outlet of FIG. 7. As shown in FIG. 8, contacts in positions 4 and 5 are moved to be closer together along axis Y than other adjacent contacts. The axis Y is parallel to the side of the outlet 300 and extends parallel to the 8 contacts 302. FIG. 9 illustrates contacts within the outlet of FIG. 7. As shown in FIG. 9, contacts 302 in positions 3 and 6 are moved back relative to the remaining contacts towards a rear wall 306 of outlet 300. Further, contacts 302 in positions 3 and 6 are moved upwards relative to the remaining contacts towards a top wall 308 of the outlet 300. The positioning of contacts 302 may be varied to alter resistive, inductive, capacitive characteristics (including signal phase delay) of contacts 302. Further, the cross sectional size of the contacts, the cross sectional shape of the contacts and/or the conductivity of the material used in the contacts may be varied to alter resistive, inductive, capacitive characteristics (including signal phase delay) of contacts 202.

Figure 10:
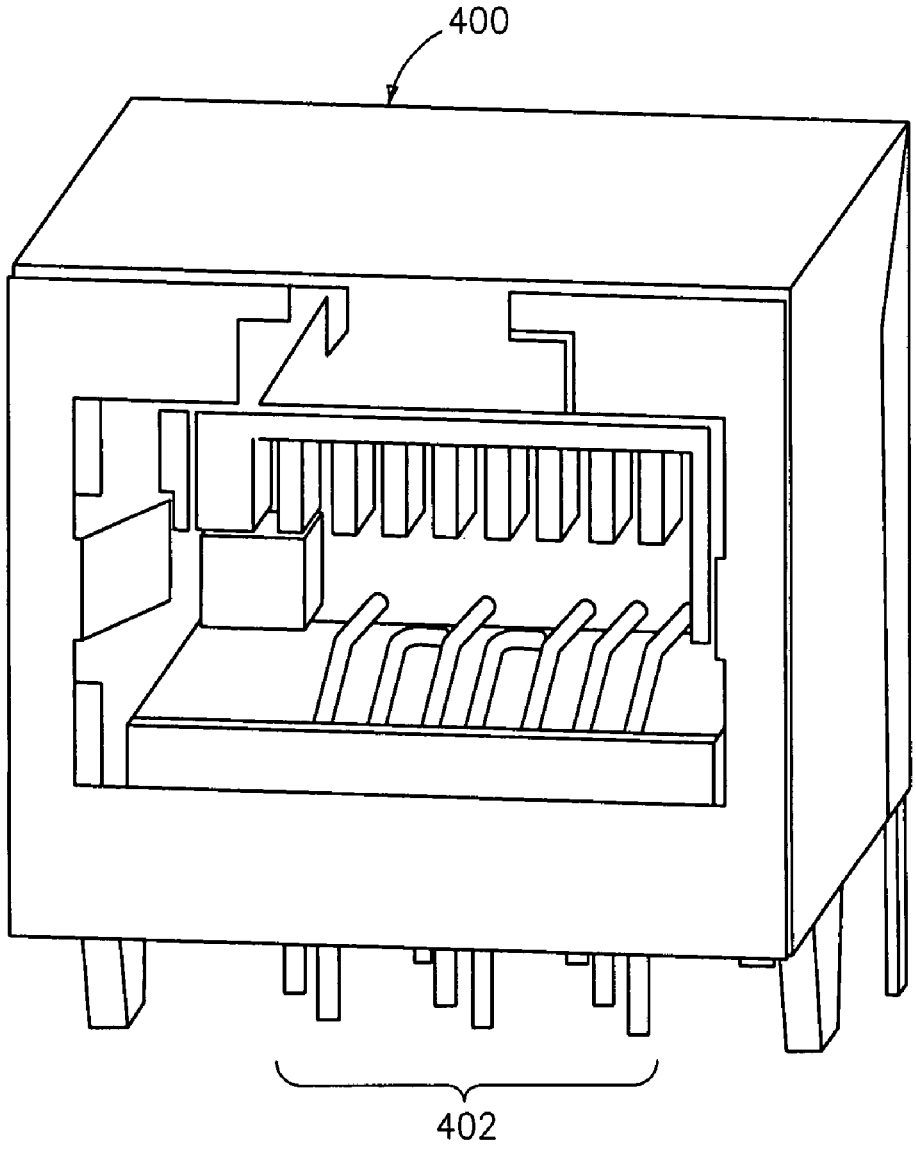
FIG. 10 is a perspective view of an outlet in alternate embodiments of the invention.

FIG. 10 is a perspective view of an outlet 400 in embodiments of the invention. As known in the art, the outlet includes eight contacts 402. It is understood that the number of contacts may vary depending on application, and embodiments of the invention are not limited to eight contacts. As is known in the art, contacts are referred to as being in eight positions 1-8, from one side of the outlet to the other. The contacts may be arranged in tip and ring pairs as is known in the art with, contacts 1/2, 3/6, 4/5 and 7/8 defining tip and ring pairs.

Figure 11:
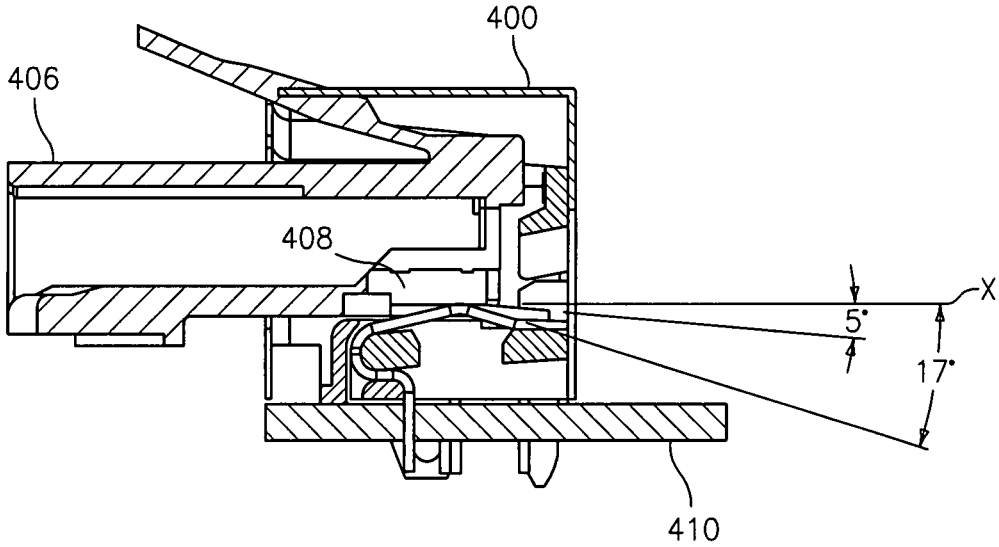
FIG. 11 is a cross-sectional view of a plug mating with the outlet of FIG. 10.
Figure 12:
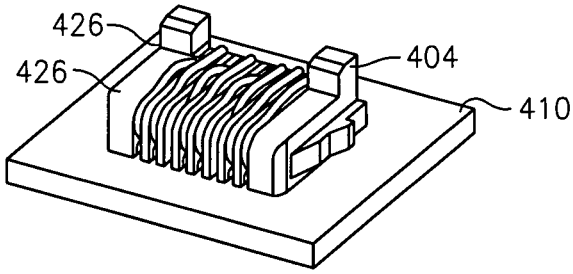
FIG. 12 is a perspective view of the contact carrier of FIG. 10 on a circuit board.

Embodiments of the invention are described with reference to contacts in different positions. As shown in FIG. 10, all contacts 402 have a bend that directs the contact towards axis X (FIG. 11). Contacts 402 in positions 4, 6 and 8 are have a higher angle with reference to axis X than contacts 402 in positions 1-3, 5 and 7 which have a smaller angle with reference to axis X. Axis X is parallel to the top surface of contact carrier 404. FIG. 11 is a cross-sectional view of a plug 406 mating with outlet 400. The bends in the contacts 402 permit the contacts 402 to maintain consistent physical and electrical contact with contacts 408 in plug 406 in mating region 426 above top surface of the contact carrier 404. The bends also provide a uniform displacement of the contacts 402 when plugs having different dimensions are mated with outlet 400. Accordingly, in the mated state, the contacts 402 are in predicted positions regardless of the size of the plug 406 or insertion depth of the plug 406 into outlet 400. This allows for control of crosstalk between contacts 402 as the location of the contacts in the mated state does not vary. FIG. 12 is a perspective view of the contact carrier 404 of FIG. 10 on a circuit board 410.

This arrangement of the contacts improves signal transmission performance by providing internal compensation to balance signals by adjusting the contacts to maximize resistive, inductive, capacitive characteristics (including signal phase delay) along contacts 402. For example, adjusting the length, adding bends, adjusting the spacing of the contacts is performed to compensate for crosstalk within the outlet. Further, the cross sectional size of the contacts, the cross sectional shape of the contacts and/or the conductivity of the material used in one or more of the contacts may be varied to alter resistive, inductive, capacitive characteristics (including signal phase delay) of contacts 402.

Figure 13:
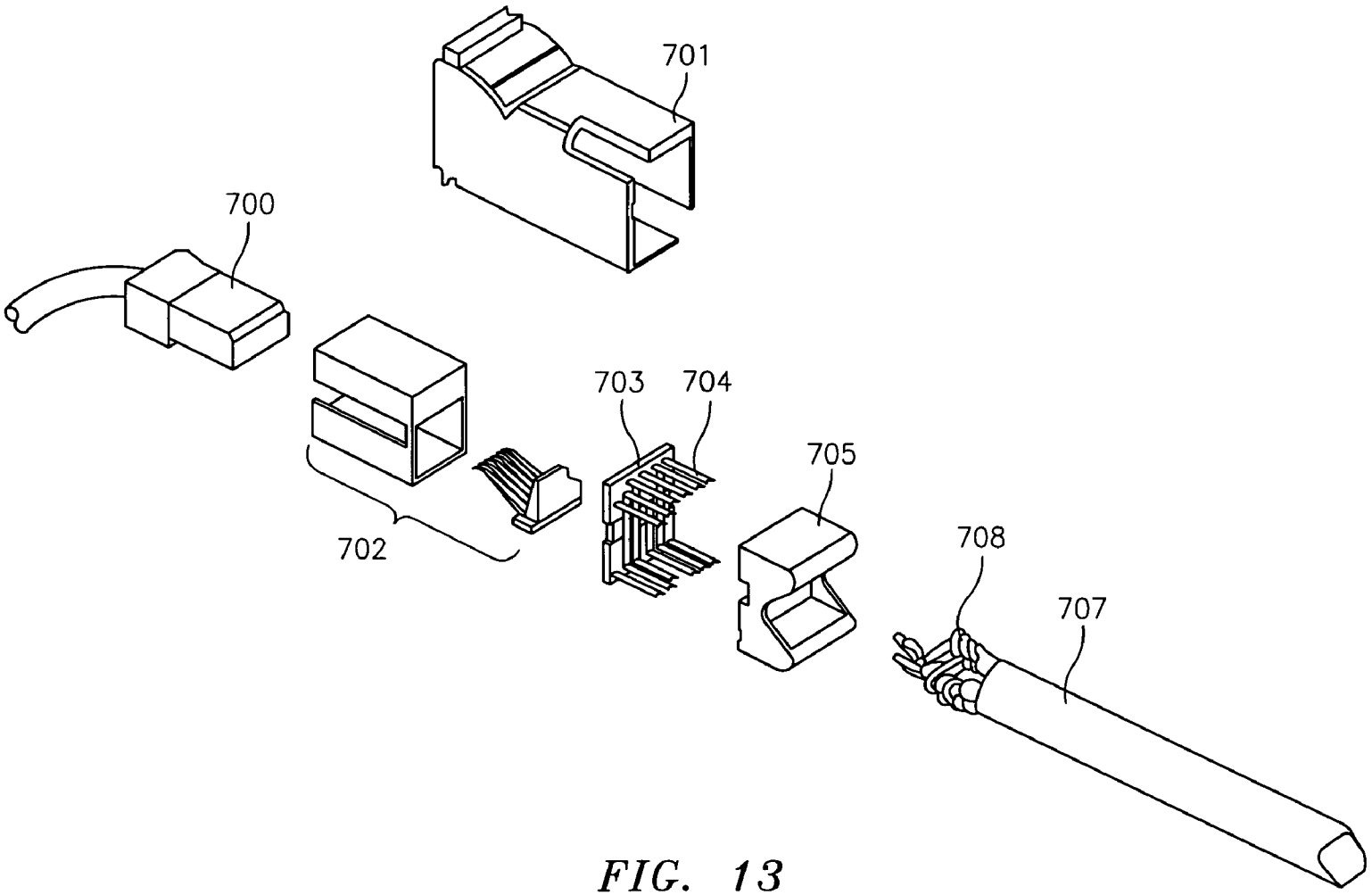
FIG. 13 is a perspective view a contact carrier in alternate embodiments.

FIG. 13 is a perspective view of an exemplary termination of wires to an outlet in embodiments of the invention. FIG. 13 depicts an exemplary connector housing 701, patch cord 700 and twisted pair cable 707. Cable 707 includes four twisted pairs of wires 708. It is understood that embodiments of the invention may be used with cables having a different color code and the invention is not limited to cables having four twisted pairs of wires. The patch cord 700 includes a plug housing dimensioned to mate with existing modular outlets. The plug housing may be an RJ-45 type plug, but may have different configurations.

Connector 701 contains a substrate 703 which establishes an electrical connection between the jack assembly 702 and termination block 705. Wire termination connections 704 (e.g., insulation displacement contacts) are positioned in the termination block 105. The substrate 703 may be a printed circuit board, flexible circuit material, etc. having traces therein for establishing electrical connection between the jack assembly 702 contacts and termination block 705 termination connections 704. Termination block 705 may be a S310 block available from The Siemon Company. Substrate 703 may include compensation elements for tuning electrical performance of the plug 100 (e.g., NEXT, FEXT). In alternate embodiments, the jack assembly contacts 702 and IDC connections 704 are part of a lead frame, eliminating the need for substrate 703.

The jack assembly 702 includes a contact carrier with contacts 720. The contacts 720 may use one or more of the geometries described above with reference to FIGS. 1-12 to improve signal transmission performance by providing internal compensation to balance signals by adjusting the contacts to maximize resistive, inductive, capacitive characteristics (including signal phase delay) along contacts 720.

For example, adjusting the length, adding bends, adjusting the spacing of the contacts is performed to compensate for crosstalk within the outlet. Further, the cross sectional size of the contacts, the cross sectional shape of the contacts and/or the conductivity of the material used in one or more of the contacts may be varied to alter resistive, inductive, capacitive characteristics (including signal phase delay) of contacts 720. The contacts 720 extend from the rear wall of the contact carrier rather than the bottom (as shown in FIGS. 1-12), but still may include similar features to improve signal transmission performance.

Figure 14:
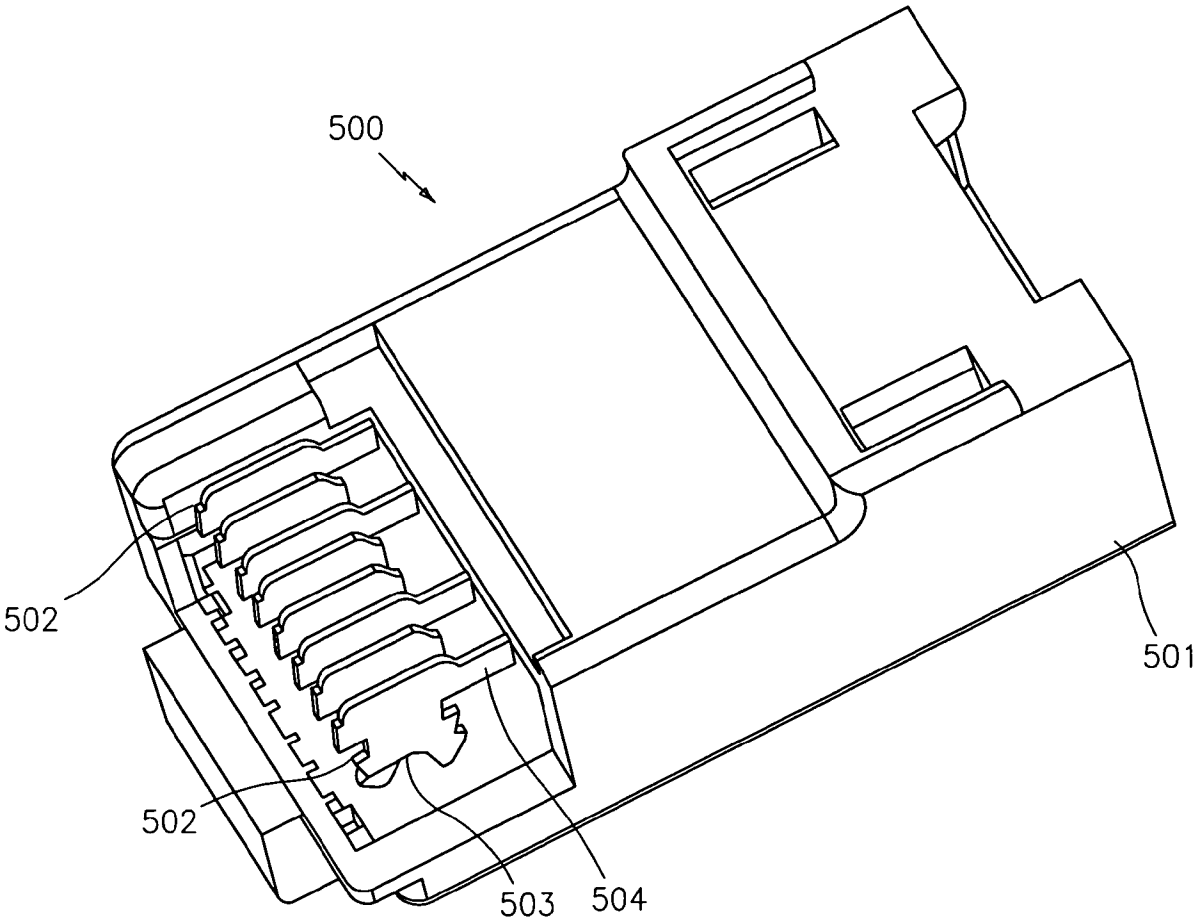
FIG. 14 is a perspective, partial cut-away view of a plug in embodiments of the invention.
Figure 15:
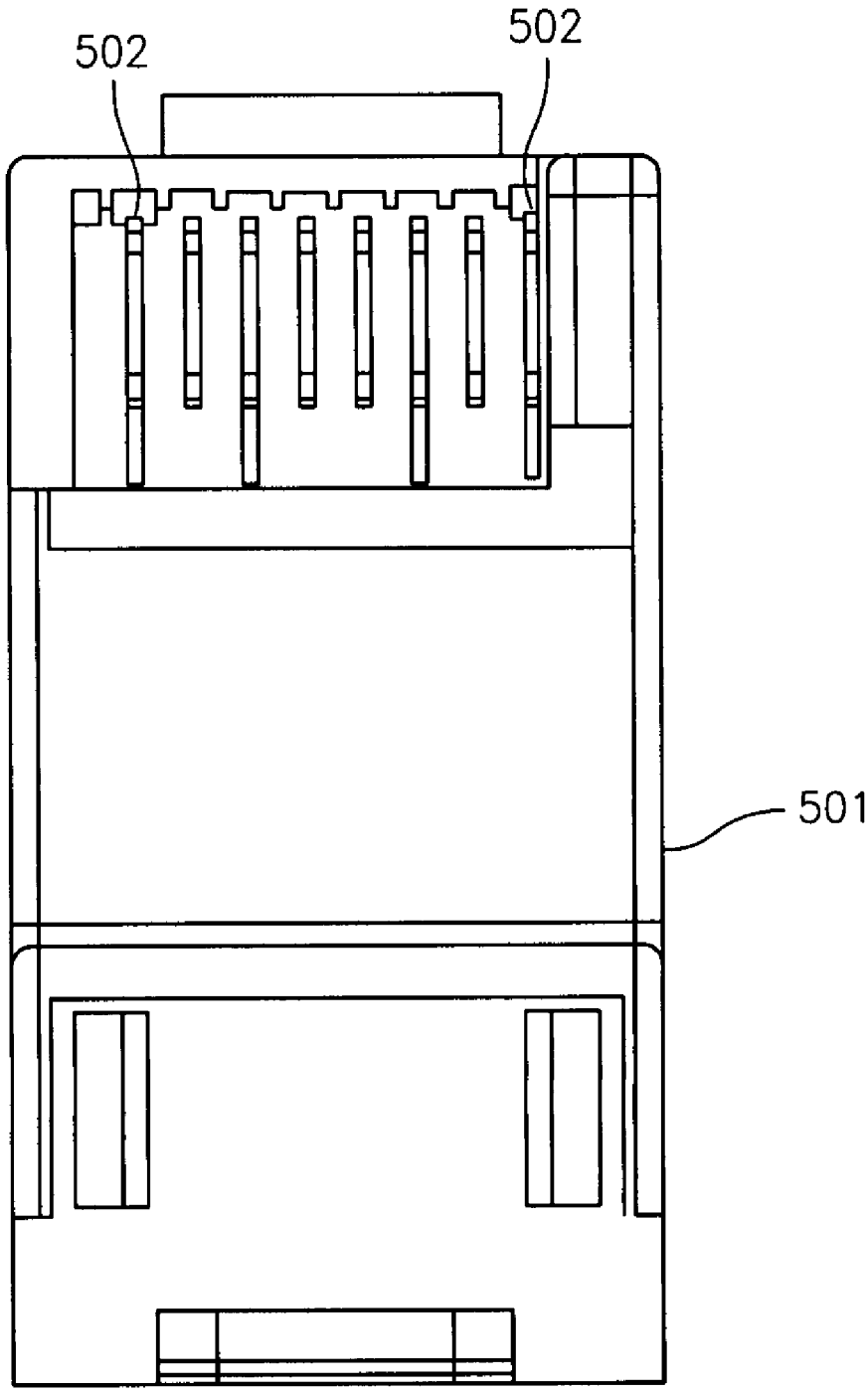
FIG. 15 is a top view of the plug of FIG. 13.

FIG. 14 is a perspective, partial cut-away view of a plug 500 in embodiments of the invention. Plug 500 includes a plug housing 501 and plug contacts 502 arranged in eight positions across the plug 500. Contacts 502 include an insulation displacement portion 503 for making electrical contact with individual wires as known in the art. The plug contacts 502 engage contacts in the outlets discussed above with reference to FIGS. 1-13. As shown in FIG. 14, the contacts 502 include extension 504. The extensions form increased surface area for the contacts and overlap in order to alter capacitive and/or inductive (e.g., reactive) interaction between contacts 502. In FIG. 14, contacts in positions 1, 3, 6 and 8 include extensions 504 to increase capacitive coupling between contacts 1 and 3 and contacts 6 and 8, respectively. It is understood that other contacts may include extensions and embodiments of the invention are not limited to FIG. 14. FIG. 15 is a top view of the plug of FIG. 14. In alternate embodiments, the contacts 502 include openings to alter capacitive and/or inductive (e.g., reactive) interaction between contacts 502. The openings may be formed uniformly across all contacts 502, or may be formed in a subset of contacts 502.

The embodiments of the invention discussed above improve the transmission performance (both signal and noise characteristics) of the RJ45 jack and/or plug by adding internal compensation within the components. The various wire forms adjust the magnitude and phase of the signals within the jack and this compensation improves overall signal integrity of the component.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A telecommunications outlet comprising:

a contact carrier;

a plurality of contacts supported on the contact carrier, the contacts corresponding to tip and ring pairs, at least one of the contacts having a characteristic to improves signal transmission performance by providing internal compensation to balance signals by controlling resistive, inductive or capacitive characteristics along the contacts;

wherein two of the contacts are shorter than other contacts such that the two contacts extend for a shorter distance in a mating region above the contact carrier, the mating region being an area where the contacts make physical and electrical contact with plug contacts;

wherein the contacts are arranged in 8 positions, the contacts in positions 3 and 6 being the two shorter contacts such that the distal ends of the contacts in positions 3 and 6 do not extend as far as the distal ends of the contacts in positions other than positions 3 and 6, the contacts in all 8 positions extending in the same direction from the top surface of the contact carrier to a distal end;

the contacts each having a bend that directs each contact downwards relative to an axis, wherein contacts in first positions have an angle with reference to an axis X higher than an angle with reference to axis X for contacts in second positions.

2. The telecommunications outlet of claim 1 further comprising:

a housing having an opening for receiving a plug;

wherein two of the contacts are positioned closer to each other than other contacts along an axis parallel to the opening.

3. The telecommunications outlet of claim 1 further comprising:

a substrate having traces in electrical connection with the contacts;

a termination block having wire termination connections in electrical connection with the traces.

4. The telecommunications outlet of claim 1 wherein the first positions are positions 4, 6 and 8 and the second positions are positions 1-3, 5 and 7.

5. The telecommunications outlet of claim 1 wherein upon mating with a plug, contacts in first positions have an angle with reference to an axis X higher than an angle with reference to axis X for contacts in second positions.

6. A telecommunications outlet comprising:

a contact carrier;

a plurality of contacts supported on the contact carrier, the contacts corresponding to tip and ring pairs, at least one of the contacts having a characteristic to improves signal transmission performance by providing internal compensation to balance signals by controlling resistive, inductive or capacitive characteristics along the contacts;

a first group of contacts have a first angle with reference to an axis parallel to the top surface of the contact carrier and a second group of contacts have a second angle with reference to the axis, the first angle and second angle being different, the first group of contacts and the second group of contacts extending in the same direction from the top surface of the contact carrier to a distal end of the first group of contacts and the second group of contacts;

the contacts each having a bend that directs each contact downwards relative to an axis, wherein contacts in first positions have an angle with reference to an axis X higher than an angle with reference to axis X for contacts in second positions.

7. The telecommunications outlet of claim 6 wherein:

at least one contact includes a bend such that the angle of the contact with reference to the axis decreases at the bend.

8. The telecommunications outlet of claim 6 further comprising:

a housing having an opening for receiving a plug;

wherein two of the contacts are positioned closer to each other than other contacts along an axis parallel to the opening.

9. The telecommunications outlet of claim 6 further comprising:

a substrate having traces in electrical connection with the contacts;

a termination block having wire termination connections in electrical connection with the traces.

10. The telecommunications outlet of claim 6 wherein the first positions are positions 4, 6 and 8 and the second positions are positions 1-3, 5 and 7.

11. The telecommunications outlet of claim 6 wherein upon mating with a plug, contacts in first positions have an angle with reference to an axis X higher than an angle with reference to axis X for contacts in second positions.

* * * * *